US010365588B2

(12) United States Patent
Levy et al.

(10) Patent No.: US 10,365,588 B2
(45) Date of Patent: Jul. 30, 2019

(54) WIPER HOLDER FOR REPRODUCTION APPARATUS

(71) Applicant: HP INDIGO B.V., Amstelveen (NL)

(72) Inventors: Nathan A. Levy, Ness Ziona (IL); Shunit Petachia Halely, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 2 days.

(21) Appl. No.: 15/749,933

(22) PCT Filed: Oct. 30, 2015

(86) PCT No.: PCT/EP2015/075355
§ 371 (c)(1),
(2) Date: Feb. 2, 2018

(87) PCT Pub. No.: WO2017/071782
PCT Pub. Date: May 4, 2017

(65) Prior Publication Data
US 2018/0224772 A1 Aug. 9, 2018

(51) Int. Cl.
*G03G 21/00* (2006.01)
*G03G 15/11* (2006.01)

(52) U.S. Cl.
CPC ..... *G03G 15/11* (2013.01); *G03G 21/0029* (2013.01); *G03G 2215/0805* (2013.01)

(58) Field of Classification Search
CPC ..... G03G 21/0088; G03G 221/0036; G03G 221/0084; G03G 15/11; G03G 13/11
See application file for complete search history.

(56) References Cited

U.S. PATENT DOCUMENTS

| | | | | |
|---|---|---|---|---|
| 4,083,633 | A | 4/1978 | Shanley | |
| 5,084,739 | A | 1/1992 | Kalyandurg et al. | |
| 6,813,466 | B1 | 11/2004 | Kopecky | |
| 7,159,962 | B2 * | 1/2007 | Wouters | B41J 2/16538 347/33 |
| 7,231,170 | B2 | 6/2007 | Lundy et al. | |
| 8,774,696 | B2 | 7/2014 | Liu et al. | |
| 2003/0049059 | A1 | 3/2003 | Gross et al. | |
| 2005/0135844 | A1 | 6/2005 | Takenouchi et al. | |
| 2006/0180291 | A1 * | 8/2006 | Rata | D21G 3/005 162/281 |

FOREIGN PATENT DOCUMENTS

| | | | | |
|---|---|---|---|---|
| CA | 519346 | | 12/1955 | |
| EP | 2878448 | | 6/2015 | |
| GB | 2116911 | | 10/1983 | |
| JP | 5912472 | | 1/1984 | |
| JP | 59188684 | A * | 10/1984 | G03G 21/0029 |
| JP | 6173179 | | 4/1986 | |
| JP | 01241587 | A * | 9/1989 | |
| JP | 09258623 | A * | 10/1997 | |

* cited by examiner

*Primary Examiner* — Benjamin R Schmitt
*Assistant Examiner* — Milton Gonzalez
(74) *Attorney, Agent, or Firm* — HP Inc. Patent Department

(57) ABSTRACT

A wiper holder comprises a body part and a first slot formed in the body part, the first slot for holding a first wiper element, where the first slot is bent to form-lock the first wiper element, and a second slot formed in the body part adjacent to the first slot, the second slot for holding a second wiper element, where the second slot is bent to form-lock the second wiper element.

14 Claims, 3 Drawing Sheets

WIPER HOLDER FOR REPRODUCTION APPARATUS

BACKGROUND

The disclosure relates to a wiper holder, in particular to a wiper holder used for wiping or cleaning a photoimaging plate or drum of a reproduction apparatus, such as a printing device.

In some reproduction apparatuses such as an electrostatographic copier or printing device, a cleaning station comprising a wiper may be required to wipe off residual ink and other particles from the photoimaging plate or drum and to distribute a thin layer of oil across the photoimaging plate or drum before every new printing cycle. For instance, the wiper may contact the surface of the photoimaging drum as the drum rotates and may detach excess marking particles and other debris and cause such waste products to fall into a container, which can then periodically be removed. The wiper may be held in place in a wiper holder that can form part of the cleaning station. The efficiency with which the wiper cleans the photoimaging plate or drum has a significant impact on the overall reproduction quality.

DETAILED DESCRIPTION

Figure 1:
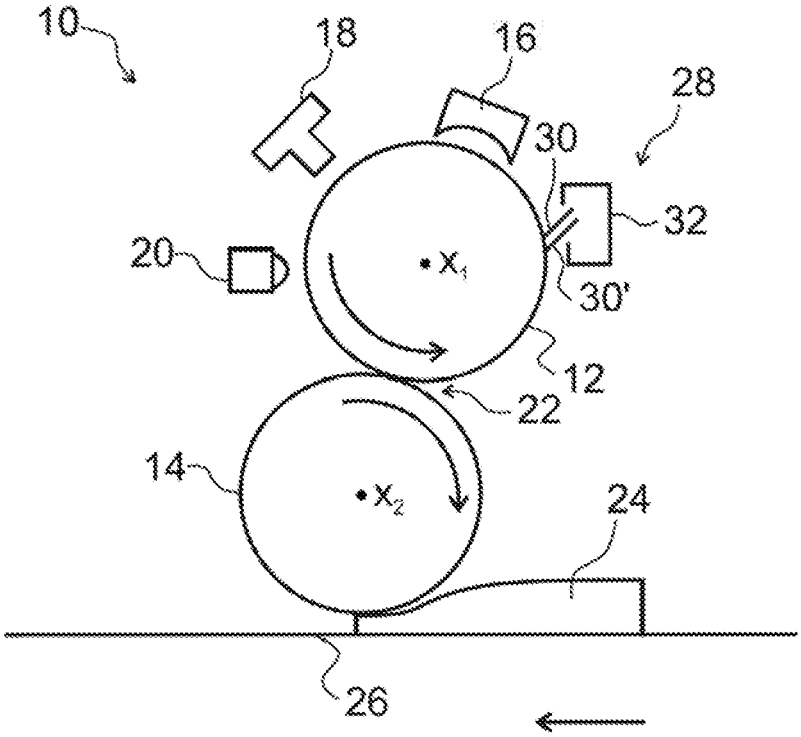
FIG. 1 is a schematic view of components of a printing device comprising a wiper holder according to an example.

A wiper holder according to the present disclosure comprises a body part, a first slot formed in said body part, said first slot for holding a first wiper element, wherein said first slot is bent to form-lock said first wiper element, and a second slot formed in said body part adjacent to said first slot, said second slot for holding a second wiper element, wherein said second slot is bent to form-lock said second wiper element.

A wiper holder with at least two wiper elements positioned adjacent to one another allows for a more thorough and more effective removal of residual ink and other particles from the photoimaging plate or drum, and thereby increases the quality of the printing. In particular, a cleaning station with at least two wiper elements provides for redundancy, which may avoid the formation of wakes on the photoimaging plate or drum of the printing device. Such wakes may form due to mechanical defects in the wiper. But in the wiper holder according to the present disclosure, as long as at least one of the wiper element is intact, the photoimaging drum may still be cleaned efficiently. Given that the probability of a defect occurring both in the first wiper element and in the second wiper element in the same position along the photoimaging plate or drum is significantly reduced, quakes may be efficiently suppressed.

The wiper holder may comprise two or more than two slots in said body part for holding a respective plurality of wiper elements adjacent to one another. By increasing the number of slots and wiper elements, respectively, the printing quality may be further enhanced.

Due to the bend or twisted design of the first slot and second slot, respectively, the first slot and second slot may form-lock said first wiper element and second wiper element, respectively. As a result, the wiper elements can be securely and reliably held in place, yet are quickly and easily replaced. In particular, the form-locked configuration allows to securely attach the first wiper element and second wiper element, respectively, without additional fixation elements. This provides for a compact design, and allows multiple wiper elements to be held in a wiper holder in close spatial proximity.

As an example, the wiper holder according to the present invention may hold said first wiper element and said second wiper element without the use of additional spring elements other separate components for the wiper gripping, thereby simplifying the assembly and enhancing the robustness of the wiper holder. The accuracy of the placement of the first and second wiper elements in the respective first and second slots is likewise enhanced, thereby increasing the cleaning accuracy.

Moreover, the form-locked configuration allows to control and adjust both the wiper deflection and the wiper free length, which effect the force applied by the wiper element on the photoimaging plate or drum, and hence the cleaning efficiency.

In an example, said first slot and/or said second slot are bent along an insertion direction of said first wiper element and said second wiper element, respectively.

This allows said first wiper element and said second wiper element to be reliably secured and carefully positioned within said first slot and said second slot, respectively.

Said first wiper element and said second wiper element may be elongated wiper elements. For example, said first wiper element and said second wiper element may be wiper elements adapted to extend across an entire width of a photoimaging drum or photoimaging plate of a reproduction apparatus. In an example, said insertion direction of said first wiper element and said second wiper element, respectively, is a direction perpendicular to said width direction.

In an example, said first slot comprises a first portion in a vicinity of a slot opening of said first slot, and a second portion adjacent to said first portion along an insertion direction of said first wiper element, wherein said first portion is straight (non-bent) and said second portion is bent.

Said straight first portion may serve for inserting said wiper element through said slot opening. Said bent or curved second portion adjacent to said first portion may serve to form-lock said first wiper element, and to hold said first wiper element securely in place at a well-defined position with respect to said photoimaging plate or drum.

In an example, said first slot may further comprise a third portion adjacent to said second portion along said insertion direction of said first wiper element, wherein said third portion is straight or non-bent.

Said third portion may be different from said first portion. In particular, said third portion and said first portion may be located on opposite sides of said second portion. Said third portion may face away from said slot opening.

In this configuration, said bent second portion may be a middle portion of said first slot.

Said second slot may be formed correspondingly. In particular, said second slot may comprise a first portion in a vicinity of the slot opening of said second slot, and a second portion adjacent to said first portion along an insertion direction of said second wiper element, wherein said first portion is straight and said second portion is bent.

Said second slot may further comprise a third portion adjacent to said second portion along said insertion direction of said second wiper element, wherein said third portion is straight.

In an example, said first slot and said second slot extend in parallel in said body part. The respective first and second wiper elements, when inserted into said first slot and second slot, respectively, may then likewise extend in parallel, and thereby allow redundant cleaning and enhance the efficiency of the cleaning process.

In an example, said first slot is bent in a first direction and said second slot is bent in a second direction different from said first direction. In particular, said second direction may be opposite from said first direction.

Bending said first slot and said second slot in different directions allows to enhance the thickness and stability of the leg separating said second slot from said first slot in said body part. In particular, said second slot and said first slot may be provided in close spatial proximity without compromising the stability of the wiper holder.

In an example, said second slot is spaced apart from said first slot by a slot distance amounting to at most two times a diameter of said first slot and/or said second slot, respectively. In particular, said slot distance may amount to at most said diameter of said first slot and/or said second slot, respectively.

The resulting wiper holder is compact, and can be integrated into a reproduction apparatus even where the available space is limited.

In an example, said first slot and said second slot are staggered in said body part. A staggered configuration allows to adapt the cleaning station to a curved photoimaging plate or photoimaging drum.

In an example, said first slot and said second slot are staggered by at least 5 mm, in particular by at least 10 mm.

Said wiper holder may further comprise said first wiper element and said second wiper element, wherein said first wiper element and said second wiper element are staggered.

Said first wiper element and said second wiper element may extend in parallel in said first slot and said second slot, respectively.

In an example, said first wiper element and said second wiper element are staggered by at least 5 mm, in particular by at least 10 mm.

Said first wiper element and/or said second wiper element may be flexible, and in particular may comprise polyurethane.

In an example, said first wiper element and said second wiper element are identical in design and/or size.

Providing a wiper holder for identical first and second wiper elements simplifies the logistics, operation and service of the reproduction apparatus.

The disclosure further relates to a system comprising a wiper holder with some or all of the features described above, and a mounting element for mounting said wiper holder in a reproduction apparatus, wherein said body part and said mounting element are shaped to form-lock with one another.

Providing a mounting element and a wiper holder in a form-lock configuration enhances the accuracy of the positioning of the wiper holder in the reproduction apparatus, and hence the reproduction quality.

In an example, the system further comprises a connection element for removably connecting said body part to said mounting element.

The disclosure further relates to a reproduction apparatus comprising a wiper holder with some or all of the features described above, or a system with some or all of the features described above, said wiper holder for holding and/or positioning said wiper elements to clean a drum or a plate, in particular a photoimaging drum or a photoimaging plate of said reproduction apparatus.

Said reproduction apparatus may comprise or may be a printing device or a copier.

The disclosure further relates to the use of a wiper holder with some or all of the features described above, or to the use of a system with some or all of the features described above to clean a drum or a plate, in particular a photoimaging drum or a photoimaging plate of a reproduction apparatus.

Specific examples for a wiper holder according to the disclosure will now be described in greater detail with reference to FIGS. 1 to 3. These Figures relate to a wiper holder for the photoimaging drum of a printing device. However, this a mere example, and one skilled in the art will readily understand that the disclosure is not so limited, and relates to wiper holders that may be employed in any kind of reproduction apparatus, and more generally to a wiper holder for a wiper element used to wipe or clean a surface.

FIG. 1 is a schematic side view of a printing device 10 in which a wiper holder according to the present disclosure may be employed. The printing device 10 comprises a photoconductive drum, such as a photoimaging drum 12 rotating counter-clockwise about a first axis $X_1$, and an intermediate transfer drum 14 rotating clockwise about a second axis $X_2$ that extends in parallel to said first axis $X_1$.

The printing device 10 further comprises a charging unit 16 for electrically charging the surface of the photoimaging drum 12. The accumulated charge is then modified by a print head 18 to create an electrostatic image on the photoimaging drum 12 in accordance with the information to be printed. A development unit 20 deposits electro ink on the surface of the photoimaging drum 12 to form an ink image corresponding to the electrostatic image generated by the print head 18.

The photoimaging drum 12 is in direct physical contact with the intermediate transfer drum 14 in a transfer region 22, and electrostatically transfers the ink image to the intermediate transfer drum 14. The intermediate transfer drum 14 then transfers the ink image to a printing medium 24 that is transported towards the intermediate transfer drum 14 on a transfer belt 26. The printing medium 24 may be a sheet of paper, cardboard, foil, or any other medium suitable to be printed.

After the charged ink has been transferred from the photoimaging drum 12 to the intermediate transfer drum 14, there usually still remains some waste ink material or other particles on the photoimaging drum 12. These materials should be removed from the surface of the photoimaging drum 12 before the new printing cycle begins. To this end, the printing device 10 comprises a cleaning unit 28 adapted to remove waste particles from the surface of the photoimaging drum 12. The cleaning unit 28 may also serve for spreading a thin layer of oil, such as in the thickness range of 20 nm, on the surface of the intermediate transfer drum 14.

The cleaning unit 28 comprises a plurality of wiper elements 30, 30' that are held in place and positioned by means of a wiper holder 32, as will now be described in additional detail with reference to FIGS. 2 and 3. FIG. 2 shows the configuration of the wiper holder 32 without the wiper elements 30, 30', whereas FIG. 3 shows the wiper elements 30, 30' inserted into the wiper holder 32. In FIGS. 2 and 3, the direction along which the wiper elements 30, 30' may be inserted into the first and second slots 36, 36' are indicated by an arrow z.

Figure 2:
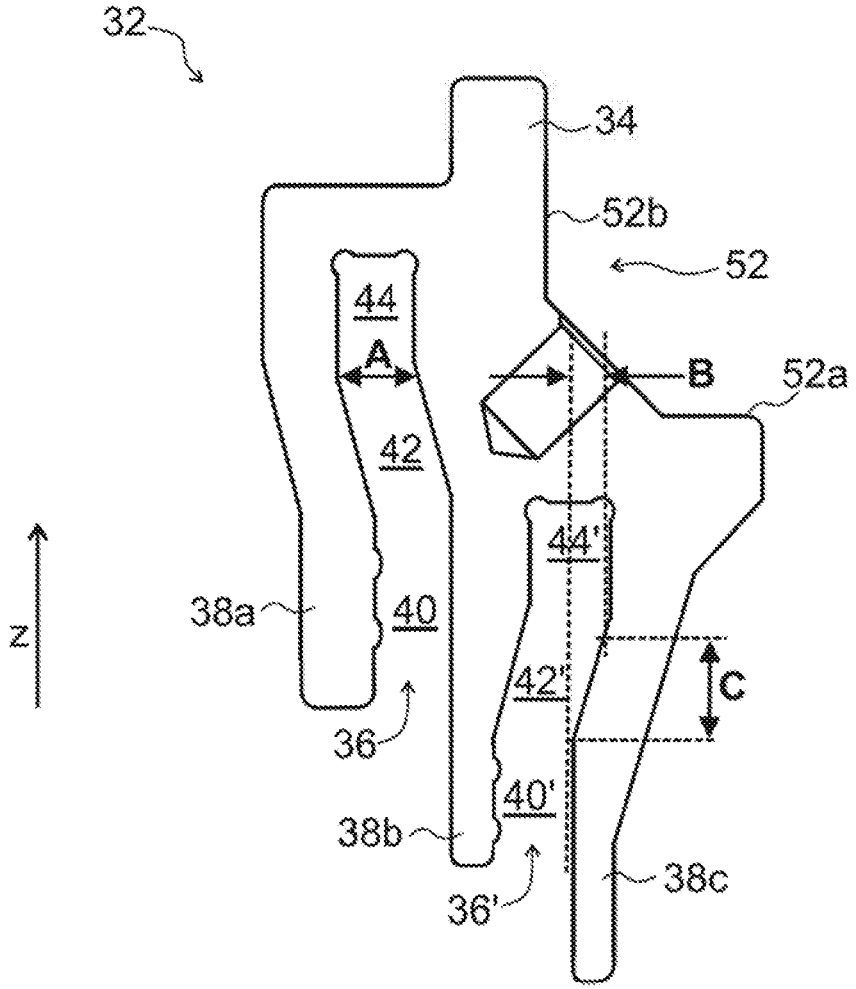
FIG. 2 is a schematic side view of a wiper holder according to an example.

FIG. 2 is a schematic side view of an example wiper holder 32. The wiper holder 32 comprises a body part 34 and first and second slots 36, 36' formed adjacent to one another in the body part 34.

In additional detail, the wiper holder 32 comprises a first leg 38*a*, a second leg 38*b*, and a third leg 38*c* that protrude generally in parallel from the body part 34. The first slot 36 is formed by and between the first leg 38*a* and the second (middle) leg 38*b*, and the second slot 36' extends between the second (middle) leg 38*b* and the third leg 38*c*.

For instance, the wiper holder 32 may be formed from metal or plastic material, and the first, second, and third legs 38*a* to 38*c* may be formed by means of metal or plastic extrusion techniques.

As can be further taken from FIG. 2, the first slot 36 and the second slot 36' do not extend straight in said wiper holder 32, but are rather bent, curved, or twisted. To this end, the inner surfaces of the first leg 38*a*, second leg 38*b*, and third leg 38*c* are bent or twisted. By means of the bend or twist, the first and second slots 36, 36' may accommodate and form-lock the respective first and second wiper elements 30, 30', as schematically shown in FIG. 3.

Figure 3:
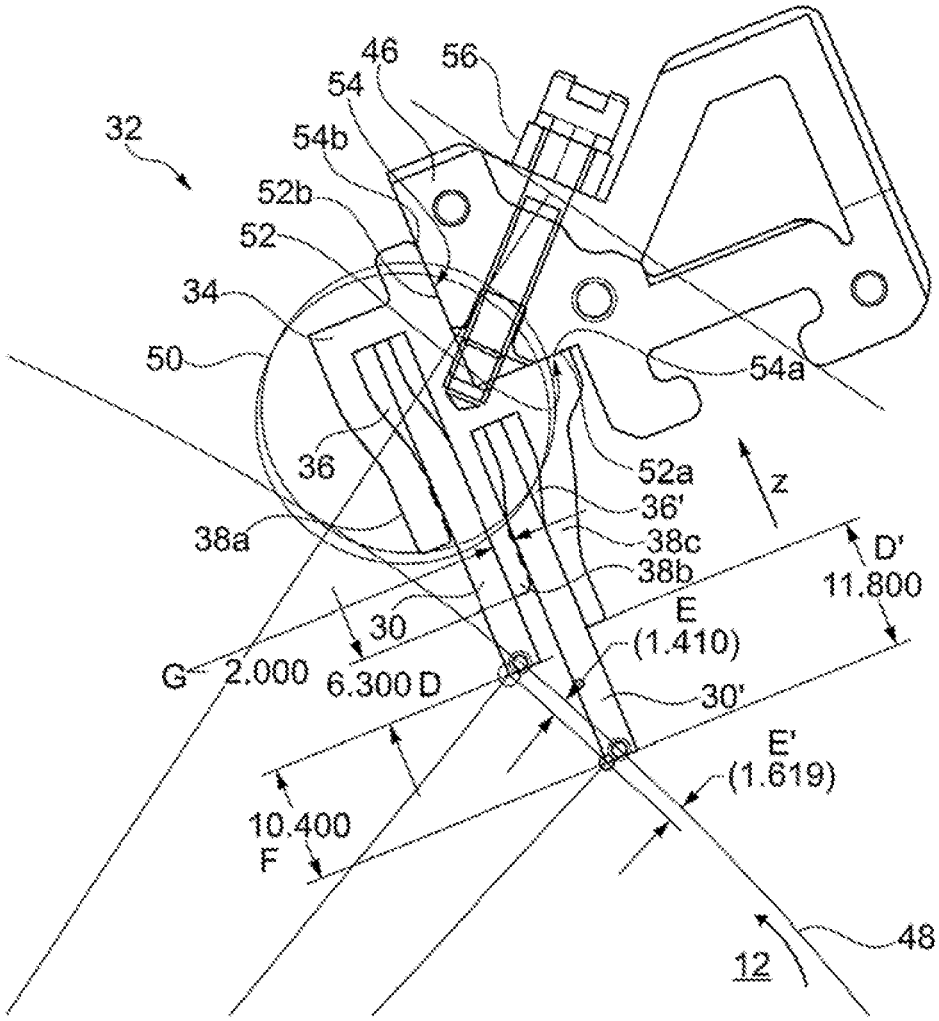
FIG. 3 is a schematic side view of an example system comprising a wiper holder and a mounting element for mounting said wiper holder in a reproduction apparatus.

As can be taken from FIGS. 2 and 3, the twist or curvature may be in opposite directions in the first and second slots 36, 36'. This configuration leads to a second (middle) leg 38*b* with enhanced thickness, and thereby enhanced mechanical stability. However, this is merely an example, and in alternative configurations the direction of twist or curvature may be identical in the first and second slots 36, 36'.

A width A of the first slot 36 and second slot 36' of the wiper holder 32 may be chosen slightly larger than a thickness of the wiper elements 30, 30' to be inserted, and in particular 5% to 20% larger than a thickness of the wiper elements 30, 30' to be inserted. For instance, for an assumed wiper element thickness of 3 mm, the width A of the first and second slots 36, 36' may be chosen at approximately 3.3 mm to 3.8 mm.

Choosing the width A of the first and second slots 36, 36' larger than the thickness of the wiper elements 30, 30' allows the wiper elements 30, 30' to be conveniently inserted, while the twist of the slots 36, 36' reliably grips at the wiper elements 30, 30' and holds them tightly in the slots 36, 36'.

As can be further taken from FIG. 2, the first slot 36 comprises a first portion 40 which is located in the vicinity of the slot opening and is straight. Further along or inwards the insertion direction z, the first slot 36 comprises a second bent or curved portion 42, which is followed further inwardly by a third straight portion 44.

Similarly, the second slot 36' comprises a first straight portion 40', a second bent portion 42' and a third straight portion 44' arranged in this order along the insertion direction z. The first and second slots 36, 36' may be generally identical in size and dimensions, with the only exception that the twist is chosen in opposite directions.

The degree with which the second portions 42, 42' of the slots 36, 36' are bent or twisted may be expressed in terms of the twist shift B and the twist height C. The twist shift B amounts to a lateral extension of the bent portions 42, 42', perpendicularly to the insertion direction z. The twist height C amounts to the height of the second portions 42, 42' along the insertion direction z. For instance, in the configuration of FIG. 2 the twist shift B may be chosen at 1.6+/−0.2 mm, and the twist height C at 5 mm +/−2 mm.

The schematic drawing of FIG. 3 shows the mounting and operation of the wiper holder 32 and printing device in additional detail.

In the configuration of FIG.3, the wiper holder 32 is mounted to a mounting element 46 to position the wiper holder 32 such that the wiper elements 30, 30' are in physical contact with an upper surface 48 of the photoimaging drum 12 of the printing device. A support wheel 50 may be mounted to the wiper holder 32 or mounting element 46 at their peripheral ends and may be in contact, during printing operation, with the surface 48 of the photoimaging drum 12, so to establish and maintain a well-defined distance between the wiper holder 32 and the surface 48 of the photoimaging drum 12.

The wiper holder 32 may be mounted to the mounting element by means of a form-lock connection. As can be taken from FIGS. 2 and 3, a contact surface 52 of the body part 34 is shaped to match and form-lock with a corresponding contact surface 54 of the mounting element 46. The contact surface 52 of the body part 34 comprises two generally perpendicular surface sections 52*a*, 52*b*. The contact surface 54 of the mounting element comprise two generally perpendicular surface sections 54*a*, 54*b* that come into contact and form-lock with the corresponding surface sections 52*a* and 52*b*, respectively. The form-lock connection established via the contact surfaces 52 and 54 keeps the wiper holder 32 in a carefully defined position with respect to the mounting element 46, and hence the photoimaging drum 12. At the same time, the form-lock connection simplifies the mounting of the wiper holder 32 to the mounting element 46.

In addition, the body part 34 of the wiper holder 32 may be secured to the mounting element 46 by means of a connection element 56, such as a screw or bolt connection.

As can be further taken from FIG. 3, the wiper elements 30, 30' are mounted in the body part 34 in a staggered configuration, so to extend generally in parallel and to touch, with their tips, the surface 48 of the photoimaging drum 12. Once the photoimaging drum 12 rotates in counter-clockwise direction during operation of the printing device, the wiper is elements 30, 30' hence wipe off residual ink or other particles from the surface 48 of the photoimaging drum 12, and may also serve to distribute a thin layer of oil across the surface 48 of the photoimaging drum 12 prior to every new printing cycle.

The efficiency of the cleaning may generally depend on the force that the wiper elements 30, 30' exert on the surface 48 of the photoimaging drum 12. This force depends on a number of parameters, comprising the wiper deflection, wiper free length, wiper thickness and wiper elasticity.

The wiper free length D, D' may be understood as the distance that the wiper elements 30, 30' extend beyond or protrude from the legs 38*a* to 38*c* of the wiper holder 32. For instance, in the configuration of FIG. 3 the free length D of the first wiper element 30 may amount to approximately 6.3 mm, and the free length D' of the second wiper element 30' may amount to approximately 11.8 mm.

The wiper deflection can be given in terms of the distance E, E' (measured along a radius direction of the photoimaging drum 12) that the first and second wiper elements 30, 30' would extend beyond the surface line of the surface 48 of the photoimaging drum 12 if the photoimaging drum 12 were fully flexible removed. For instance, in the configuration of FIG. 3 the deflection E of the first wiper element 30 may amount to approximately 1.41 mm, and the deflection E' of the second wiper element 30' may amount to approximately 1.619 mm.

In the staggered configuration of FIG. 3, the height difference F between the tips of the wiper elements 30, 30' may amount to approximately 10.4 mm.

The wiper holder according to the example allows to control and adjust both the deflection and the free length of the wiper elements 30, 30', and can suit a large range of thickness and wiper elasticity. The staggered configuration and bent design allows the wiper elements 30, 30' to be mounted in parallel and close spatial proximity, which may be expressed in terms of the width G of the second (middle) leg 38*b* of the wiper holder 32. For instance, the thickness G may be chosen smaller than 5 mm, and in particular smaller than 3 mm. FIG. 3 shows a design in which the thickness G, and hence the gap between the adjacent wipers 30, 30' amounts to approximately 2 mm.

The wiper holder 32 according to the example allows for a quick and easy replacement of the wiper elements 30, 30', and allows the free length, gap, height, and deflection of the wiper elements 30, 30' to be adjusted over a large parameter range, thereby allowing to control the force that the wiper elements 30, 30' exert on the surface 48 of the photoimaging drum 12. Moreover, the critical parameters remain stable even under the wiper insertion force and engage force. The design further ensures a good gripping of the wiper elements 30, 30' even in an oily environment.

The description of the examples and the figures merely serve to illustrate the disclosure, but should not be understood to imply a limitation. The scope of the disclosure is to be determined solely from the appended claims.

REFERENCE SIGNS

10 printing device
12 photoimaging drum
14 intermediate transfer drum
16 charging unit
18 printhead
20 development unit
22 transfer region
24 printing media
26 transfer belt
28 cleaning unit
30, 30' wiper elements
32 wiper holder
34 body part of wiper holder 32
36, 36' first, second slots of wiper holder 32
38*a, b, c* first, second, third leg of wiper holder 32
40, 40' first (straight) portion of slots 36, 36'
42, 42' second (bent) portion of slots 36, 36'
44, 44' third (straight) portion of slots 36, 36'
46 mounting element
48 surface of photoimaging drum 12
50 support wheel
52 contact surface of body part 34
52*a*, 52*b* surface sections of contact surface 52
54 contact surface of mounting element 46
54*a*, 54*b* surface sections of contact surface 54
56 connection element

The invention claimed is:

1. A wiper holder, comprising:
a body part;
a first leg that protrudes from the body part;
a second leg that protrudes from the body part;
a third leg that protrudes from the body part;
a first slot formed in said body part between the first leg and the second leg, said first slot for holding a first wiper element, wherein said first slot is bent to form-lock said first wiper element, wherein the first slot comprises a first portion that is straight, a second portion that is bent, and a third portion that is straight; and
a second slot formed in said body part between the second leg and the third leg and adjacent to said first slot, said second slot for holding a second wiper element, wherein said second slot is bent to form-lock said second wiper element, wherein the second slot comprises a first portion that is straight, a second portion that is bent, and a third portion that is straight, wherein said second portion of the first slot is bent in a first direction and said second portion of said second slot is bent in a second direction that is opposite from said first direction, wherein the first wiper element and the second wiper element contact a surface of a photoimaging drum.

2. The wiper holder according to claim 1, wherein said first slot and/or said second slot are bent along an insertion direction of said first wiper element and said second wiper element, respectively.

3. The wiper holder according to claim 1, wherein said first portion of said first slot is in a vicinity of a slot opening of said first slot, and said second portion is adjacent to said first portion along an insertion direction of said first wiper element.

4. The wiper holder according to claim 3, wherein said third portion is adjacent to said second portion along said insertion direction of said first wiper element, wherein said third portion is straight.

5. The wiper holder according to claim 1, wherein said second slot extends in parallel to said first slot.

6. The wiper holder according to claim 1, wherein said second slot is spaced apart from said first slot by a slot distance, said slot distance amounting to at most two times a diameter of said first slot and/or said second slot, respectively.

7. The wiper holder according to claim 1, wherein said first slot and said second slot are staggered in said body part.

8. The wiper holder according to claim 7, wherein said first slot and said second slot are staggered by at least 5 mm.

9. The wiper holder according to claim 1, further comprising said first wiper element and said second wiper element, wherein said first wiper element and said second wiper element are staggered and/or extend in parallel in said first slot and said second slot, respectively.

10. The wiper holder according to claim 9, wherein said first wiper element and said second wiper element are identical in size.

11. A system comprising:
a wiper holder, comprising:
a body part;
a first leg that protrudes from the body part;
a second leg that protrudes from the body part;
a third leg that protrudes from the body part;
a first slot formed in said body part between the first leg and the second leg, said first slot for holding a first wiper element, wherein said first slot is bent to form-lock said first wiper element, wherein the first slot comprises a first portion that is straight, a second portion that is bent, and a third portion that is straight; and
a second slot formed in said body part between the second leg and the third leg and adjacent to said first slot, said second slot for holding a second wiper element, wherein said second slot is bent to form-lock said second wiper element, wherein the second slot comprises a first portion that is straight, a second portion that is bent, and a third portion that is straight, wherein said second portion of the first slot is bent in a first direction and said second portion of said second slot is bent in a second direction that is opposite from said first direction; and a mounting element for mounting said wiper holder in a reproduction apparatus, wherein said body part and said mounting element are shaped to form-lock.

12. The system according to claim 11, further comprising a connection element for removably connecting said body part to said mounting element.

13. A reproduction apparatus, comprising:

a wiper holder, the wiper holder comprising:

a body part;

a first leg that protrudes from the body part;

a second leg that protrudes from the body part;

a third leg that protrudes from the body part;

a first slot formed in said body part between the first leg and the second leg, said first slot for holding a first wiper element, wherein said first slot is bent to form-lock said first wiper element, wherein the first slot comprises a first portion that is straight, a second portion that is bent, and a third portion that is straight; and a second slot formed in said body part between the second leg and the third leg and adjacent to said first slot, said second slot for holding a second wiper element, wherein said second slot is bent to form-lock said second wiper element, wherein the second slot comprises a first portion that is straight, a second portion that is bent, and a third portion that is straight, wherein said second portion of the first slot is bent in a first direction and said second portion of said second slot is bent in a second direction that is opposite from said first direction, said wiper holder for holding positioning said first wiper element and second wiper element to clean a drum or a plate of said reproduction apparatus.

14. The reproduction apparatus of claim 13, further comprising:

a mounting element for mounting said wiper holder in the reproduction apparatus, wherein said body part and said mounting element are shaped to form-lock.

* * * * *